United States Patent [19]

Mazelli

[11] 4,025,315

[45] May 24, 1977

[54] METHOD OF ODORIZING LIQUID NATURAL GAS

[75] Inventor: Jack R. Mazelli, Montebello, Calif.

[73] Assignees: San Diego Gas & Electric Co., San Diego; Dual Fuel Systems, Inc., Los Angeles, both of Calif.

[22] Filed: May 19, 1971

[21] Appl. No.: 144,796

[52] U.S. Cl. ..... 44/52; 44/59; 48/195; 48/196 FM; 261/DIG. 17

[51] Int. Cl.[2] ..... C10J 1/28; C10L 1/24

[58] Field of Search ..... 48/195, 196 FM, 196 R, 48/196 US; 44/52, 59; 261/DIG. 17; 252/408

[56] References Cited

UNITED STATES PATENTS

| | | | |
|---|---|---|---|
| 1,905,817 | 4/1933 | Dobrovolny | 48/195 UX |
| 1,944,175 | 1/1934 | Frey | 48/195 X |
| 2,032,431 | 3/1936 | Odell | 48/195 |
| 2,869,994 | 1/1959 | Nevers et al. | 48/195 |
| 3,545,949 | 12/1970 | Oister | 48/195 |
| 3,689,237 | 9/1972 | Stark et al. | 48/196 R X |
| 3,761,232 | 9/1973 | Klass et al. | 48/195 X |

*Primary Examiner*—Joseph Scovronek
*Attorney, Agent, or Firm*—Christie, Parker & Hale

[57] ABSTRACT

Liquid natural gas is odorized with either ethyl or methyl mercaptan by initiallly mixing the odorant with a diluent and then introducing the resultant mixture into the liquid natural gas. It is preferred that the diluent have a freezing point below the boiling point of liquid natural gas. It is theorized that with the diluent the mercaptans either do not freeze or are dispersed sufficiently in the liquid natural gas to reduce the particle size of frozen odorant. In any event, the result is effective odorization of natural gas drawn from a liquid natural gas storage tank regardless of the amount of liquid and gaseous natural gas left in the tank.

15 Claims, 4 Drawing Figures

INVENTOR.
JACK R. MAZELLI
BY
Christie, Parker & Hale
ATTORNEYS

METHOD OF ODORIZING LIQUID NATURAL GAS

BACKGROUND OF THE INVENTION

The present invention relates to odorizing natural gas in general and, more in particular, to the odorizing of natural gas in its liquid form.

Storage of natural gas in its liquid form is becoming increasingly common. Typically, liquid natural gas is drawn from a liquid natural gas storage vessel and vaporized outside the vessel before it is used. Obviously, at least the vaporized natural gas should be odorized for leak detection purposes.

It has long been known that ethyl and methyl mercaptans are effective odorants for natural gas. Only a very small amount of mercaptan is necessary to effectively odorize natural gas. For example, with methyl mercaptan 0.06 to 0.1 grains per 100 SCF of natural gas is sufficient to warn of natural gas leaks. However, the odorant is extremely pungent and unpleasant in concentrations above that required to warn of gas leaks.

Consequently, it is highly desirable to use only as much mercaptan as is necessary to warn of the presence of an excessive amount of gas and to definitely avoid over-odorization.

Both ethyl and methyl mercaptans freeze at a temperature which is quite a bit higher than the boiling point of liquid natural gas. This has presented a problem in odorizing liquid natural gas.

The problem is that frozen mercaptan does not dissolve fast enough to effectively odorize the liquid natural gas. As a consequence it has proven difficult in the past to effectively odorize liquid natural gas.

With the increasing demand for stored liquid natural gas, for example, in liquid natural gas-powered motor vehicles, the problem of effective odorization of liquid natural gas becomes acute.

SUMMARY OF THE INVENTION

The present invention provides a method for odorizing liquid natural gas in such a manner that the mercaptans can be used as odorants without concern of mercaptan dissolution rate into the liquid.

The invention contemplates mixing of an odorant selected from the class of odorants consisting of ethyl and methyl mercaptan with a diluent and the subsequent introduction of the resultant mixture into liquid natural gas. It is preferred that the diluent have a freezing point lower than the boiling point of liquid natural gas. A preferred diluent is liquid propane which freezes at about −300° F. In one case, however, a diluent consisting of methane under high pressure proved effective with ethyl mercaptan in the odorization of liquefied natural gas.

It is also preferred to introduce the diluent-mercaptan mixture into the liquid natural gas in such a manner as to effect rapid dispersal of the mercaptan throughout the liquid natural gas. This may be done by using a gaseous diluent, such as methane, under pressure, or it may be done by agitating the liquid natural gas during the introduction of the diluent mercaptan mixture. As an example of the degree of agitation effective to rapidly disperse mercaptan, sufficient agitation can be achieved in the process of charging liquid natural gas into the vessel in which it will be odorized.

It has been found that a concentration of about 10% by volume ethyl mercaptan in diluent of propane is sufficient to effectively odorize liquid natural gas over the latter's full liquid vapor range in a vessel. Clearly, lesser concentrations would also be effective. On a mole basis the 10% by volume concentration works out to be about one part ethyl mercaptan odorant to nine parts propane diluent. However, the method has been effective at lower concentrations.

These and other features, aspects and advantages of the present invention will become more apparent from the following description, appended claims and drawings.

DESCRIPTION OF THE PREFERRED EMBODIMENTS

The present invention generally contemplates the mixing of an odorant selected from the class consisting of ethyl and methyl mercaptan with a diluent.

The preferred odorant is ethyl mercaptan because of the extremely obnoxious odor associated with methyl mercaptan. The mercaptan, in any event, is mixed with a diluent and then is introduced into liquid natural gas.

The amount of odorant required typically is no more than about 0.06 to 0.1 grains per 100 cu. ft. of gas at standard temperature and pressure. If effective odorization of vapor above liquid natural gas is desired, 0.6 to 1.0 grains of odorant in the liquid will suffice.

It has been found that about one part ethyl mercaptan odorant to about nine parts propane diluent on volume percent basis is satisfactory. It is expected that higher concentrations of ethyl mercaptan in propane could be used. Obviously, however, lower concentrations of the ethyl mercaptan odorant in the propane diluent is satisfactory.

It is not known for sure why the diluent is effective in introducing mercaptan odorants into liquid natural gas. It is suspected that the diluent lowers the freezing point of the mercaptan so that less of the mercaptan is frozen by the liquid natural gas.

Figure 4:
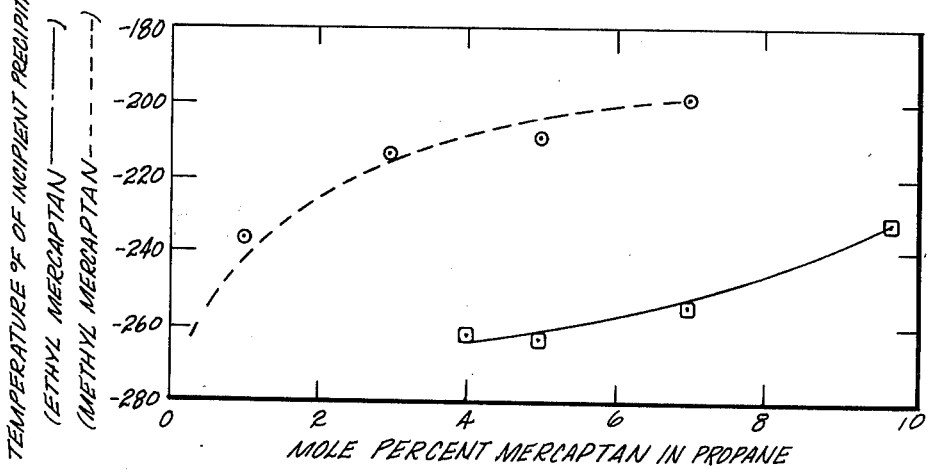
FIG. 4 illustrates in graph form the freezing point depression of both ethyl and methyl mercaptan as the mole percentage decreases in the preferred diluent propane.

If the mechanism is freezing point depression of mercaptan, the problem of mercaptan solidification because of the low temperature of liquid natural gas is not present at all if the ethyl mercaptan is mixed with propane in the concentrations of less than about 5.7 mole percent ethyl mercaptan in propane, as shown in FIG. 4. This mole percentage of ethyl mercaptan in propane does not show any signs of solidification of the ethyl mercaptan at the −259° F. temperature typically taken as the boiling point of liquid natural gas.

For methyl mercaptan the mole percentage is lower. For methyl mercaptan, FIG. 4 indicates that approximately 0.3 mole percent methyl mercaptan in propane will not precipitate out any methyl mercaptan. This concentration is far more than is necessary to serve as a warning.

If higher concentration of mercaptan in the diluent is required for some reason, it is highly desirable to get the diluent-mercaptan mixture into the liquid natural gas and disperse it as rapidly as possible.

With these considerations in mind this description will now turn to the Figures. The Figures, incidentally, merely illustrate typical methods of odorizing liquid natural gas.

Figure 1:
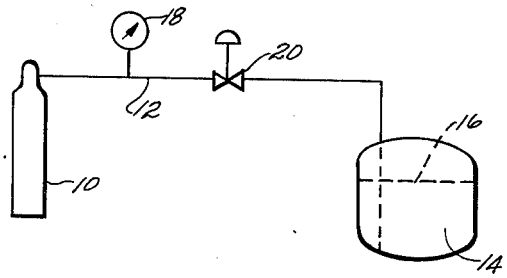
FIG. 1 illustrates schematically one acceptable method of introducing the odorant-diluent mixture in a liquid natural gas contained in a vessel.

With reference to FIG. 1, a gas cylinder 10 for the storage of pressurized methane and odorant is in series communication through a line 12 with a liquid natural gas storage vessel 14. The level of liquid natural gas is shown by a horizontal phantom line 16. Line 12 extends below the surface of the level of the liquid natural gas for the effective mixing of the diluent-mercaptan mixture in the liquid. A pressure gauge 18 is in line 12 to monitor the pressure. A flow control valve 20 is also in the line to control and throttle the flow of methane and mercaptan into the liquid natural gas contained in the storage vessel. In this specific case the diluent is high-pressure methane, a gas, and the odorant is ethyl mercaptan. The mixture of diluent and mercaptan is injected into the liquid natural gas vessel. It is simply bubbled into the liquid. The amount of odorant put into the liquid natural gas can readily be ascertained with knowledge of the odorant concentration in gas cylinder 10 and by correlating that with the pressure drop registered by gauge 18.

Figure 2:
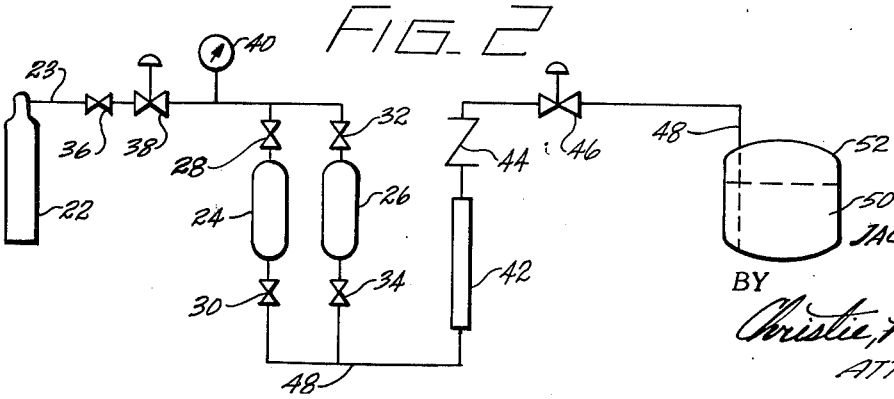
FIG. 2 illustrates schematically another method for introducing the odorant-diluent mixture into liquid natural gas in a vessel.

Turning to FIG. 2, a slightly different method of odorizing liquid natural gas is illustrated. In this Figure a high pressure gas cylinder 22 for natural gas is in series through a line 23 with an odorant-diluent mixture tank 24 and an odorant-free diluent purge tank 26. The odorant-diluent mixture tank and odorant-free diluent purge tank are in parallel circuit with each other. On-off valves 28 and 30 are at the entrance and exit to the odorant-diluent mixture tank. Similarly, on-off valves 32 and 34 are at the entrance and exit of the odorant-free diluent purge tank. Upstream from the tank in series between the tanks and the high pressure gas cylinder is a shutoff valve 36, a pressure control regulator 38 and a pressure gauge 40. Downstream from tanks 24 and 26 is a flow measurement rotameter 42 which is in series with a check valve 44 and a flow control valve 46. Line 48, in which rotameter 42, check valve 44 and flow control valve 46 are disposed, leads into liquid natural gas storage vessel 50 and, as before, exits near the bottom of the tank for the bubbling of the diluent-odorant mixture into the tank. The diluent here is a liquid propane and its level is shown by the horizontal phantom line at 52.

The high pressure cylinder gas from cylinder 22 provides the injection pressure, which is controlled by regulator 38, for injecting a propane-ethyl mercaptan mixture from tank 24 into the liquid natural gas in tank 50. Downstream from the odorant-diluent mixture tank, rotameter 42 reads the amount of mixture flowing through line 48, which amount is controlled by throttling through flow control valve 46. When the proper amount of odorant has been introduced into the liquid natural gas contained in the natural gas storage tank, the odorant-diluent mixture tank is taken out of circuit. The high pressure gas cylinder is also taken out of circuit. Then the odorant-free diluent tank is brought into circuit to purge the line of the odorant. This feature is advantageous when the liquid natural gas storage vessel is taken away from the charging station. It must be appreciated that the concentration of odorant in the diluent before it is mixed with the liquid natural gas is quite high and as a consequence the odor level will be very high.

Figure 3:
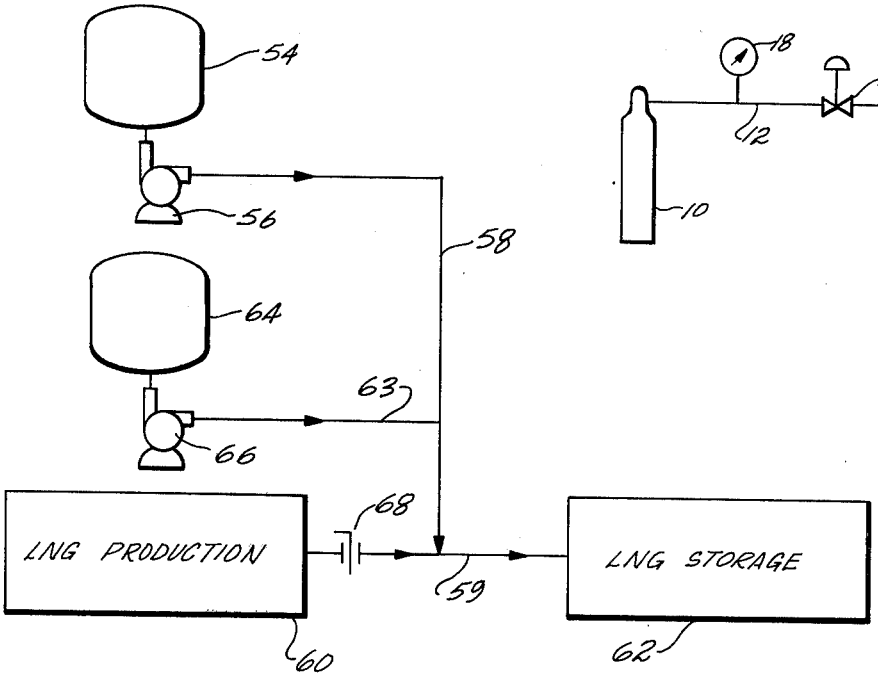
FIG. 3 illustrates still another method which is suitable for the odorization of liquid natural gas but similar to that illustrated in the first two Figures.

Turning to FIG. 3, another method for odorizing liquid natural gas is illustrated. This Figure shows a diluent storage tank 54 in series with a proportioning pump 56 through a line 58. Line 58 is connected into a line 59 which extends between a liquid natural gas production facility 60 and a liquid natural gas storage facility 62. Through a line 63 an odorant storage tank 64 is in parallel with diluent storage tank 54. A proportioning or metering pump 66 in line 63 serves to introduce metered amounts of odorant into line 58 for mixing with diluent from storage tank 54. The resultant mixture passes into the liquid natural gas line 59 between liquid natural gas storage vessel 62 and production facility 60. A meter 68 in line 59 measures the flow rate from production facility 60 to storage vessel 62.

It is theorized that with the diluent the mercaptans either do not freeze or are dispersed sufficiently in the liquid natural gas to reduce the particle size of frozen odorant. In any event, the result is effective odorization of natural gas drawn from a liquid natural gas storage tank regardless of the amount of liquid and gaseous natural gas left in the tank.

What is claimed is:

1. A method of odorizing liquid natural gas comprising the steps of:

a. forming a mixture of a diluent and an odorant selected from the class of odorants consisting of ethyl mercaptan and methyl mercaptan, the diluent having a freezing point at atmospheric pressure below the boiling point of liquid natural gas at that pressure; and b. introducing the mixture in an odorant effective amount into the liquid natural gas.

2. The method claimed in claim 1 wherein the diluent is liquid propane.

3. The method claimed in claim 2 wherein the odorant is ethyl mercaptan and the mixture includes up to about ten percent by volume ethyl mercaptan.

4. The method claimed in claim 2 wherein the introduction step includes forcing the mixture from storage into the liquid natural gas with gaseous natural gas under pressure.

5. The method claimed in claim 4 wherein the liquid natural gas is being charged into a vessel during the introduction of the mixture.

6. The method claimed in claim 5 wherein the mixture is in a storage vessel prior to its introduction into the liquid natural gas vessel, the mixture is introduced into the liquid natural gas vessel through at least one line and the line is purged with natural gas discharged into the liquid natural gas vessel after the purge.

7. The method claimed in claim 1 wherein the diluent and odorant are mixed with sufficient diluent to prevent any substantial precipitation of odorant after the mixture is introduced into the liquid natural gas.

8. The method claimed in claim 2 wherein the introduction step includes forcing the mixture into the liquid natural gas by pressure.

9. The method claimed in claim 8 wherein the liquid natural gas is agitated during the introduction of the mixture to disperse the odorant.

10. The method claimed in claim 9 wherein the pressure forcing is by natural gas under pressure.

11. The method claimed in claim 1 wherein the diluent is methane gas and the introduction step includes forcing the mixture into the liquid natural gas by pressure.

12. The method claimed in claim 11 wherein the liquid natural gas is agitated during the introduction of the mixture to disperse the odorant.

13. The method claimed in claim 11 wherein the pressure forcing is by natural gas under pressure.

14. A method for providing cryogenic liquefied natural gas with sufficient soluble levels of a mercaptan odorant selected from the class consisting of ethyl mercaptan and methyl mercaptan, including dissolving said odorant in a liquefied hydrocarbon gas carrier, said carrier being miscible with the cryogenic liquefied gas, said carrier having a boiling point which is higher than that of the cryogenic liquefied gas, said odorant being dissolved in said carrier at concentrations greater than could be dissolved in the cryogenic liquefied gas, and combining said cryogenic liquefied gas and minor volumes of said carrier with dissolved odorant so that said cryogenic liquefied gas component of said mixture contains detectable concentrations of odorants.

15. A method which includes the steps of claim 14 wherein said carrier is a liquefied lower alkane hydrocarbon.

* * * * *

UNITED STATES PATENT AND TRADEMARK OFFICE

CERTIFICATE OF CORRECTION

PATENT NO. : 4,025,315

DATED : May 24, 1977

INVENTOR(S) : Jack R. Mazelli

It is certified that error appears in the above-identified patent and that said Letters Patent are hereby corrected as shown below:

In the Abstract, lines 6 through 12, delete "It is theorized that . . . left in the tank."

Column 4, line 29, claim 1, after "odorizing" insert --cryogenic--.

Signed and Sealed this

*thirtieth* Day of *August 1977*

[SEAL]

*Attest:*

RUTH C. MASON
*Attesting Officer*

C. MARSHALL DANN
*Commissioner of Patents and Trademarks*